US007913840B2

(12) United States Patent
Kealy

(10) Patent No.: US 7,913,840 B2
(45) Date of Patent: Mar. 29, 2011

(54) BALL CARRIER DEVICE

(76) Inventor: Benjamin John Kealy, Atlanta, GA (US)

( * ) Notice: Subject to any disclaimer, the term of this patent is extended or adjusted under 35 U.S.C. 154(b) by 184 days.

(21) Appl. No.: 12/221,120

(22) Filed: Jul. 31, 2008

(65) Prior Publication Data

US 2009/0032419 A1 Feb. 5, 2009

Related U.S. Application Data

(60) Provisional application No. 60/962,769, filed on Jul. 31, 2007.

(51) Int. Cl.
*B65D 83/00* (2006.01)
*B65D 85/00* (2006.01)
*A63B 57/00* (2006.01)

(52) U.S. Cl. ..... 206/315.9; 224/196; 224/251

(58) Field of Classification Search ..... 206/315.9, 206/315.1, 315.5, 579, 229; 224/196, 251; D3/221; D9/712; D21/796; 221/309
See application file for complete search history.

(56) References Cited

U.S. PATENT DOCUMENTS

| | | | | | |
|---|---|---|---|---|---|
| 3,047,140 | A * | 7/1962 | Seymour Robins | ..... | 206/315.9 |
| D202,991 | S * | 11/1965 | Carlson | ..... | D3/221 |
| 4,042,156 | A * | 8/1977 | Knight | ..... | 206/315.9 |
| 4,678,108 | A * | 7/1987 | Inman | ..... | 224/274 |
| 4,927,052 | A * | 5/1990 | Marthaler et al. | ..... | 221/64 |
| 5,139,189 | A * | 8/1992 | Hanley | ..... | 206/315.9 |
| 5,186,374 | A * | 2/1993 | Buxton | ..... | 224/191 |
| 5,641,103 | A * | 6/1997 | Potik et al. | ..... | 224/251 |
| D394,548 | S * | 5/1998 | Lee | ..... | D3/221 |
| 5,772,090 | A * | 6/1998 | Rodriguez | ..... | 224/251 |
| 5,839,631 | A * | 11/1998 | Hebert et al. | ..... | 224/251 |
| 5,898,968 | A * | 5/1999 | Beattie | ..... | 15/210.1 |
| 6,003,747 | A * | 12/1999 | Lee | ..... | 224/250 |
| 6,021,896 | A * | 2/2000 | Marshall | ..... | 206/315.9 |
| 6,029,850 | A * | 2/2000 | Pate et al. | ..... | 221/64 |
| 6,234,307 | B1 * | 5/2001 | Beck | ..... | 206/315.9 |
| 6,357,586 | B2 * | 3/2002 | Pratt et al. | ..... | 206/315.9 |
| 2001/0050241 | A1 * | 12/2001 | Pratt et al. | ..... | 206/315.9 |

* cited by examiner

*Primary Examiner* — J. Gregory Pickett

(57) ABSTRACT

A ball carrier for transporting a plurality of balls. The ball carrier includes a sleeve having a diameter adapted to receive a golf ball. The ball carrier has a first open end and second frusticonical shaped end adapted to support one or more golf balls in the sleeve. A slotted opening is disposed in the second frusticonical shaped end and is adapted to secure various balls disposed within the carrier.

16 Claims, 1 Drawing Sheet

FIG. 1
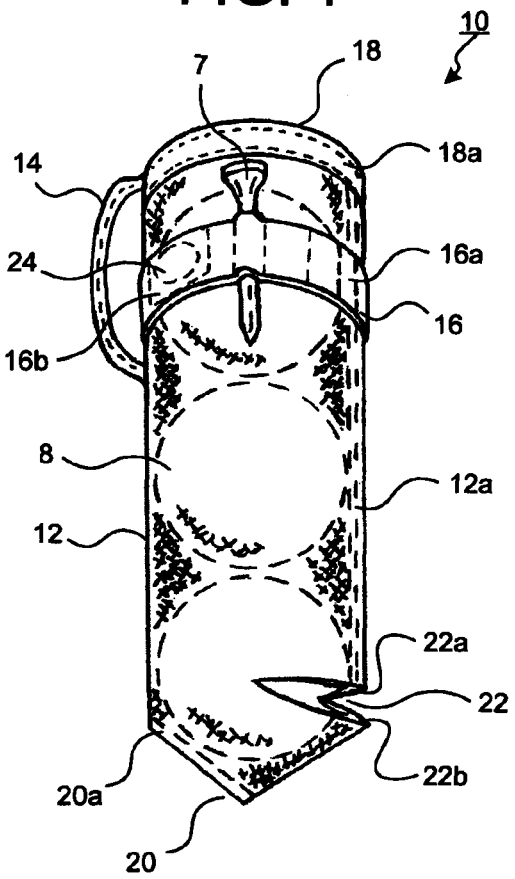
FIG. 2
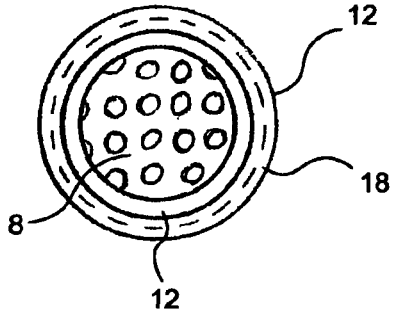
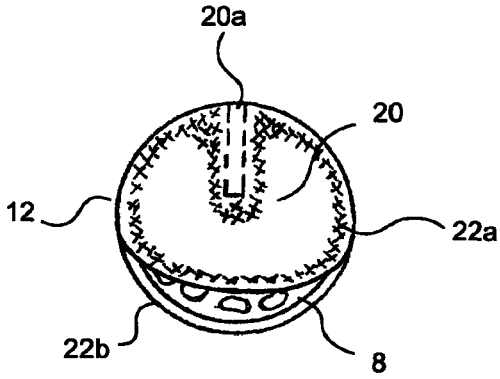
FIG. 3
FIG. 4
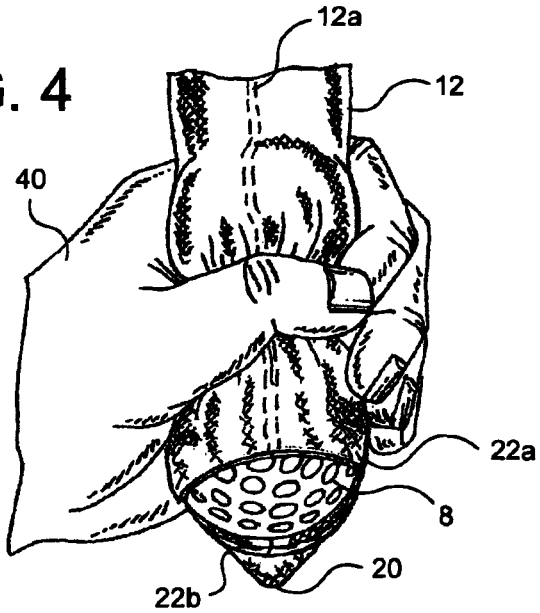

BALL CARRIER DEVICE

CROSS REFERENCE TO RELATED APPLICATION

This application is a Non-Provisional which claims the benefit of the filing date of U.S. Provisional Application Ser. No. 60/962,769, entitled "BALL CARRIER DEVICE" filed Jul. 31, 2007, the entirety of which is incorporated herein.

BACKGROUND OF THE INVENTION

1. Field of the Invention

This invention relates to a ball carrier, and in particular for holding smaller balls for games and sports, such as for example, golf balls, ping-pong, tennis, lacrosse, racquetballs and the like.

2. Description of the Related Art

Conventionally, it has been cumbersome and inconvenient for a golfer to carry golf balls on his person. Otherwise, the golfer will find himself at a loss for a ball when he cannot locate his ball which may have strayed off the fairway. Consequently, the golfer will have to trek back to their golf bag or golf cart to retrieve a new ball to continue on with their game. Since it is not convenient for a golfer to carry golf balls in their sales packaging and/or in their pockets, there is a need for a portable golf ball carrying device in which the golfer can conveniently carry on their person and quickly dispense a few extra golf balls as needed throughout the game.

Various pouches and carrying devices have been previously proposed, however, the prior art devices are not as durable and cannot properly support a golf ball's weight or jarring action of the golfer on the golf course. Traditionally, most ball carriers were integrated into the golf bag and/or caddy cart. Numerous disadvantages are inherent in the durability of their use and manufacture of the earlier golf ball carrying devices. For example, some require expensive tooling, molds, and materials. Those that were made of plastic broke easily and those made of metal having mechanical parts, like springs, were easily damaged, rusted and bent and made inoperable.

Attempts were also made at producing a soft golf ball carrying pouch. However, these prior art devices included closure mechanisms which were difficult to open and close. Likewise, other device could not adequately support the weight of the balls and/or the jarring motion of the athlete during their sporting event.

It is clear that this problem has not been solved and there is still a longstanding need for a portable, yet durable quick release carrying case for golf balls which will not fall from the contained under the weight of the ball and/or subjected to the jarring motion of the golfer while they are on the golf course. In accordance with this invention, an exemplary carrying device and configuration is described and shown below which solves this problem.

SUMMARY OF THE INVENTION

The present invention addresses the shortcomings identified in providing a portable, yet durable quick release ball holder.

An object of this invention is to provide a portable ball holder for carrying a plurality of balls and dispensing them with ease. The ball holder includes a soft resilient sleeve having a diameter slightly less than that of a diameter of a golf ball and having first open end for receiving the balls and a second frusticonical shaped end for supporting and dispensing the balls.

The second frusticonical shaped end includes a slotted opening which is adapted to enhance the rigidity of the second dispensing end to counteract the weight and downward jarring forces that may result from a user while engaging in their chosen sport.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein:

FIG. 1 illustrates a perspective view of a ball holder in accordance with this invention.

FIG. 2 illustrates a top view of the ball holder in accordance with this invention.

FIG. 3 illustrates a bottom view of the ball holder in accordance with this invention.

FIG. 4 depicts the extraction of a ball from the ball holder in accordance with this invention.

DETAILED DESCRIPTION OF EXEMPLARY EMBODIMENTS

Particular embodiments of the present invention will now be described in greater detail with reference to the figures.

FIG. 1 illustrates a perspective view of a ball holder 10. The ball holder 10 is adapted to hold various sizes of smaller balls for games and sports, such as for example, golf balls, ping-pong, tennis, lacrosse, racquetballs and the like.

The ball holder 10 includes a sleeve 12, a strap 14, and a tee 7 and ball marker 24 retainer 16. The ball holder 10 is composed of a ball receiving end 18 and a ball dispensing end 20.

For exemplary purposes of this invention, the ball holder 10 will be described as a golf ball holder capable of holding more than one golf ball 8 and having a diameter substantially similar to the diameter of a golf ball (approximately 1.75 inch). The fabric sleeve 12 is constructed from an appropriate padded fabric formed from a rectangular piece joined with a sewn seam 2. The sleeve 12 may be any length sufficient to support a number of golf balls, say for example, approximately 9 inches long.

FIG. 2 is a top view of the ball holder 10 illustrating the ball receiving end 18. As shown, the opening at the ball receiving end 18 may be constructed slightly smaller than the diameter of a golf ball 8 (shown in hidden line) to prevent the golf ball 8 from escaping through the ball receiving end 18. Alternatively, the ball receiving end 18 may be stabilized and reinforced with a layer 18*a* (as shown in FIG. 1) of an elastomeric material sufficient to prevent the golf ball 8 from escaping from the sleeve 12 through the ball receiving end 18.

FIG. 3 and FIG. 1. illustrate a bottom view of the ball holder 10 depicting the ball dispensing end 20. The ball dispensing end 20 includes a slotted opening 22 having an upper lip 22*a* and a lower lip 22*b* through which the golf balls 8 are dispensed. The ball dispensing end 20 is constructed with a frusticonical shape. The frusticonical shape provides an enhanced degree of rigidity and produces greater upward resultant forces to counteract the weight of the golf balls and any downward jarring forces.

In particular, the frusticonical shape design provides better overall support and prevents the golf balls 8 from slipping through the slotted opening 22 under the force of gravity and/or extraneous force due to a jarring action encountered as the golfer moves on the golf course. As shown, the frusticonical shaped end of the ball dispensing end 20 may be constructed by wrapping a single piece of material into a seam 20*a*. The seams 20*a* and 12*a* may be fastened together in any number of possible manners, including but not limited to, stitching the material, bonding, fusing, an adhesive, and/or any other method for fastening the material together.

The slotted opening 22 may be constructed as a slotted circumferential aperture disposed at approximately at a location where the frusticonical shape of the ball dispensing end 20 meets the lowermost portion of the cylindrical sleeve 12. The location and size of the slotted opening 22 take into consideration the size of the ball to be fed through the slotted opening 22 and the amount of continuous material needed to provide opposing resultant forces to overcome the weight and normal jarring movement projected by the golf balls 8 as the golfer moves along the golf course.

The ball holder 10 may be made from a variety of flexible elastomeric materials, such as for example: neoprene, vinyl, vinyl denier taffeta, fabric-lied foam rubber, or a canvas shell with a dense cotton padding, a stretch cotton fabric, nylon, and any other material capable of providing the elasticity described in accordance with this invention.

In operation, the golf balls 8 are inserted into the ball holder 10 by pushing the golf balls 8 into the ball receiving end 18 until the first ball inserted reaches the ball dispensing end 20. As the golf balls 8 are pushed in gently, the fabric distorts somewhat and the elastic sleeve 12 stretches outward to allow the golf balls 8 to pass though the sleeve 12. The golf balls 8 are secured within the sleeve 12 under the contraction force of the elastic sleeve 12 being stretched.

FIG. 4 illustrates the exemplary mode for dispensing the golf balls 8. As shown, the golf balls 8 are dispensed when the user 40 applies a downward squeezing pressure to the sleeve 12 in the direction of the ball dispensing end 20. The pressure exerted by the hand 40; overcomes the counteracting resultant forces exerted by the frusticonical shaped end of the ball holder 10, and forces the lowermost golf ball 8 adjacent to the ball dispensing end 20 through the stretched open slotted opening 22 of the ball holder 10. The slotted opening 22 stretches large enough to allow the golf ball 8 to be dispensed through the slotted opening 22 and out of the ball holder 10. Once the dispensed golf ball 8 clears the slotted opening 22, it is expelled from the ball holder 10 and the frusticonical end of the ball holder 10 and the slotted opening 22 snap back into place (as shown in FIG. 1) to retain any remaining golf balls 8.

Referring back to FIG. 1, an exemplary embodiment for the retainer 16 is depicted to suitably hold a plurality of golf tees 7 and/or a ball marker 24. As shown, the retainer 16 is constructed as a circumferential strap encircling the sleeve 12 defining a plurality of tee receiving slots 16*a* and at least one marker receiving pocket 16*b*.

A strap 14 may also be integrated as part of the ball holder 10. Although the strap 14 shown simply depicted in a belt loop configuration being attached at both ends, it is within the scope of this invention to design the strap in a variety of different ways so that at least one end of the strap 14 may be released and secure, for example using Velcro, or the like. Alternatively, the strap 14 may be replaced with a hook fastening clip element and/or any other carrying mechanism for attaching one object to another, such as for example by attaching the ball holder 10 to a golf bag, the handle of a golf cart or steering wheel and/or on the belt of the golfer where the golfer is not wearing a belt.

As mentioned previously, although the present invention has been described with reference to a particular golf ball carrying implementation, other ball carrying embodiments and/or versions are possible. Also, other alternative materials may be used such as fabric-lined closed cell neoprene, fabric-lined foam rubber, or a canvas shell with dense cotton padding. Additional pockets may be included to hold a score card, a pencil, a divot fixer, a spike cleaner, a ball brush, and/or any other items.

It is also understood that the ball holder 10 may be adapted to be conveniently attached to sports bags and caddy carts as well as directly to the user. This invention will not damage golf bags, clothing, or balls since according to one exemplary embodiment the holder is made of soft resilient material. The holder 10 is portable and compact and does not add any substantial volume beyond the dimensions of the golf balls carried therein. This invention may be made of common materials which are available in a large variety of colors and patterns. The construction of the holder in is economical to manufacture because the cost of material and simple construction is low. The ball holder 10 of this invention may be utilized as a promotional item. Dispensing of the balls 8 from the ball holder 10 is easy and can be done with one hand.

It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. A ball carrier for transporting at least one ball having a first diameter, comprising:

a sleeve, having a second diameter slightly less than the first diameter of the ball, and having a first open end for receiving the ball and a second conical shaped end for dispensing the ball, wherein a lower end of the conical shaped end is closed; and a slotted opening disposed in the second conical shaped end adapted to secure the ball disposed within the ball carrier and through which the ball is dispensed.

2. The ball carrier as recited in claim 1, wherein the sleeve is made of an elastic material constructed from a rectangular piece joined by a seam.

3. The ball carrier as recited in claim 1, wherein the first open end is reinforced with a layer of an elastomeric material sufficient to prevent the ball from escaping out from within the sleeve through the first open end of the sleeve.

4. The ball carrier as recited in claim 1, wherein the slotted opening has a wide-mouth opening including an upper lip and a lower lip, which together expand open in response to a dispensing force applied to the ball nearest the wide-mouth opening, wherein the wide-mouth opening is composed of a material and thickness including a degree of rigidity that counteracts a weight of a plurality of balls stacked in the sleeve and prevents the balls from falling through the wide-mouth opening in the conical shaped end.

5. The ball carrier as recited in claim 4, wherein the material and thickness is constructed to sustain the weight of the plurality of balls stacked in the sleeve and downward jarring forces produced by a user wearing the ball carrier engaged in an athletic event.

6. The ball carrier as recited in claim 4, wherein the wide-mouth opening is constructed as a slotted partial circumferential aperture disposed at approximately an intersecting location where the conical shaped end meets a cylindrical lowermost portion of the sleeve.

7. The ball carrier as recited in claim 2, wherein the at least one ball is a plurality of balls.

8. The ball carrier as recited in claim 7, wherein to fill the sleeve, as each of the balls is loaded into the sleeve at the first open end of the sleeve, the elastomeric material of the sleeve stretches outward to receive the balls, and produces an elastic grabbing force that causes the sleeve to secure balls within the sleeve.

9. The ball carrier as recited in claim 8, wherein the balls are dispensed by squeezing the sleeve so that the wide-mouth opening stretches large enough to allow the ball closest to the conical shaped end to be dispensed out from within the ball carrier.

10. The ball carrier as recited in claim 1, wherein the balls are selected from at least one of: a golf ball; a ping-pong; a tennis ball; a lacrosse ball; and a racquetball.

11. The ball carrier as recited in claim 1, wherein the material of the ball carrier is selected from at least one of: neoprene; vinyl; vinyl denier taffeta; fabric-lied foam rubber; a canvas shell with a dense cotton padding; a stretch cotton fabric and nylon.

12. The ball carrier as recited in claim 1, wherein a retainer is provided to suitably hold at least one of: a belt clip; a plurality of golf tees; a ball marker; a score card; a pencil; a divot fixer; a spike cleaner; and a ball brush.

13. A golf ball carrier for transporting a plurality of golf balls comprising:

a flexible sleeve having a diameter slightly less than that of a diameter of a golf ball and having a first open end and second conical shaped end, wherein a lower end of the conical shaped end is closed; and a slotted wide-mouth opening disposed in the second conical shaped end adapted to secure the golf ball disposed within the carrier, and to dispense the golf ball through the slotted wide-mouth opening when the golf ball closest to the slotted wide-mouth opening is urged through the slotted wide-mouth opening.

14. The golf ball carrier as recited in claim 13, wherein the golf ball carrier is further comprised of:

a first flexible fabric sheet material adapted to construct the flexible sleeve having first and second side marginal edges, the first and second side marginal edges of the flexible fabric sheet material are secured together along an axial length of the sleeve; and a second flexible fabric sheet material attached to an end of the flexible sleeve adapted to construct the second conical shaped end disposed at a lower end of the ball carrier.

15. The golf ball carrier as recited in claim 13, further including a retaining device adapted to secure at least one of: a belt clip; a tee; a ball marker; a score card; a pencil; a divot fixer; a spike cleaner; and a ball brush.

16. A golf ball carrier for transporting at least one golf ball comprising:

a elastomeric sleeve having an open end into which the golf ball is received, and a conical shaped end, wherein a lower end of the conical shaped end is closed; and a wide-mouth opening disposed in the conical shaped end adapted to cup and secure the golf ball within the elastomeric sleeve, wherein when a squeezing pressure is applied to the elastomeric sleeve, the golf ball is urged and dispensed through the wide-mouth opening in the conical shaped end.

* * * * *